US005471941A

United States Patent [19]

Sakuma

[11] Patent Number: 5,471,941

[45] Date of Patent: Dec. 5, 1995

[54] INCREMENTALLY ROTATABLE THREAD FEEDING DEVICE FOR SEWING MACHINES

[75] Inventor: Kouichi Sakuma, Yamagata, Japan

[73] Assignee: Suzuki Manufacturing, Ltd., Japan

[21] Appl. No.: 249,725

[22] Filed: May 26, 1994

[30] Foreign Application Priority Data

Jun. 8, 1993 [JP] Japan ..... 5-137840

[51] Int. Cl.[6] ..... D05B 47/04

[52] U.S. Cl. ..... 112/255

[58] Field of Search ..... 112/242, 243, 112/225, 199, 246, 302, 254, 255, 278

[56] References Cited

U.S. PATENT DOCUMENTS

| | | | |
|---|---|---|---|
| 981,125 | 1/1911 | Schoenfeld | 112/225 |
| 2,413,014 | 8/1944 | Wall | 112/225 |
| 2,659,329 | 11/1953 | Hale | 112/199 |
| 3,508,690 | 4/1970 | Pozzolo | 223/99 |
| 3,540,392 | 11/1970 | Kaplan | 112/225 |
| 3,763,804 | 10/1973 | Reich | 112/225 |
| 3,978,802 | 9/1976 | Hamlett | 112/254 |
| 4,023,512 | 5/1977 | Miyamoto et al. | 112/242 |
| 4,075,959 | 2/1978 | Zocher et al. | 112/225 |
| 4,098,208 | 7/1978 | Hedegaard | 112/254 X |
| 4,188,896 | 2/1980 | Brown et al. | 112/225 |
| 4,198,915 | 4/1980 | Peterson et al. | 112/225 |
| 4,300,465 | 11/1981 | Tsuboi | 112/255 |
| 4,325,314 | 4/1982 | Niem | 112/199 |
| 4,341,171 | 7/1982 | Johnson | 112/254 X |
| 4,783,931 | 10/1989 | Takagi et al. | 112/255 X |
| 5,042,407 | 8/1991 | Jimenez | 112/254 |
| 5,165,582 | 11/1992 | Andrews | 223/99 |
| 5,327,841 | 7/1994 | Sakuma | 112/262.1 |

FOREIGN PATENT DOCUMENTS

| | | | |
|---|---|---|---|
| 3710231 | 3/1987 | Germany . | |
| 59-118191 | 7/1984 | Japan . | |
| 63-240895 | 10/1988 | Japan . | |
| 3257592 | 10/1988 | Japan | 112/254 |

*Primary Examiner*—Clifford D. Crowder
*Assistant Examiner*—Ismael Izaguirre
*Attorney, Agent, or Firm*—Lorusso & Loud

[57] ABSTRACT

A thread feeding device for a sewing machine, is simply constructed but can feed a plurality of looper threads individually in amounts necessary for each seam with adjustment of the tensions of the looper threads by one adjustment knob. The thread feeding device includes a shaft fixed on the machine body orthogonally of the feeding direction of a plurality of threads. A rotor is mounted on the shaft as to rotate intermittently in one direction only. A plurality of thread holders are provided on the rotor for holding and letting off the threads individually. In each thread holder the radius from the center of rotation of the rotor to the position where the thread is held is set to a value corresponding to the individual length of feed of the thread.

5 Claims, 8 Drawing Sheets

FIG. 7
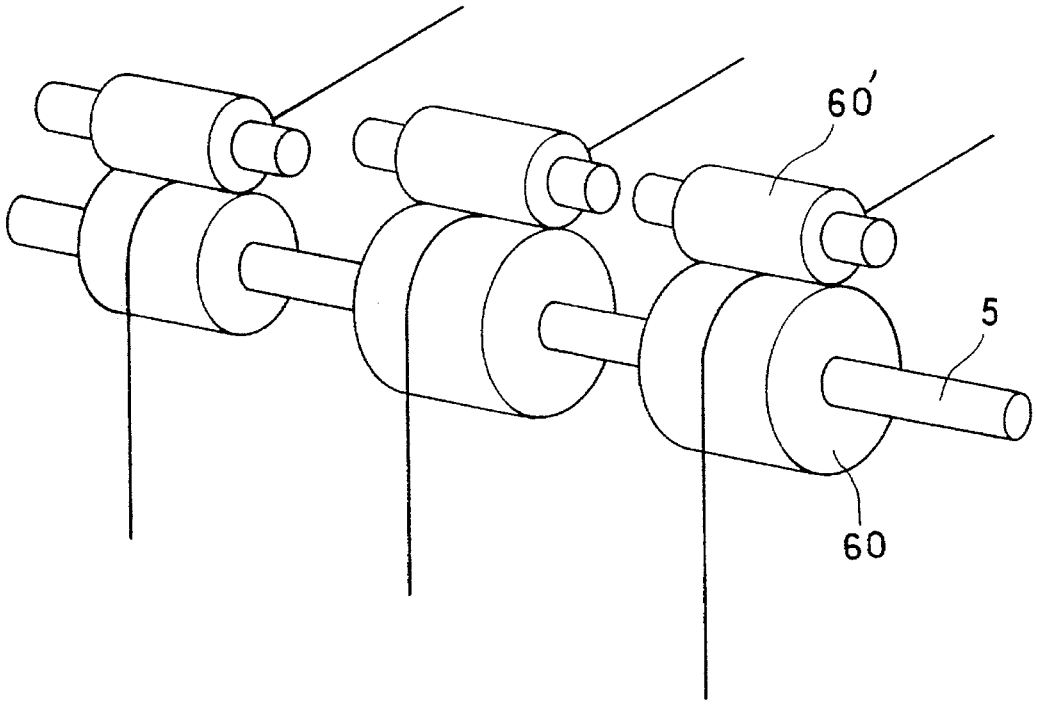
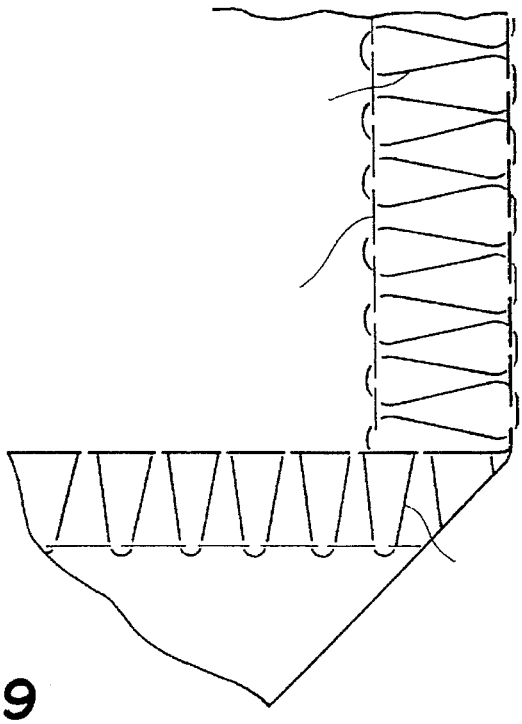
FIG. 9

INCREMENTALLY ROTATABLE THREAD FEEDING DEVICE FOR SEWING MACHINES

BACKGROUND OF THE INVENTION

1. Field of the Invention

The present invention relates to a thread feeding device for feeding/controlling threads, necessary for one seam, to two or more needles and/or loopers of a sewing machine and, more particularly, to a thread feeding device capable of adjusting the feeds of the threads by a single operation.

2. Description of the Related Art

In a sewing machine equipped with pluralities of needles and loopers, such as an overlock sewing machine, generally speaking, the feeds of threads to the needles and the loopers are effected by thread feeding mechanisms of the let-off and rotary types. In the let-off type, the threads are let off by the actions of the needle take-ups and the loopers, and the amounts necessary for one seam are adjusted by a thread tensioning device such as tension discs disposed in the individual feed paths of the threads.

In a three-thread overlock sewing machine, for example, the individual threads including the needle threads and the upper and lower looper threads let off their bobbins are fed to the needles and the upper and lower loopers, respectively, through the thread tension discs and thread guides disposed on the individual face plates. Then, the needles and the loopers act to tension and slacken the threads between the seam already formed by one sewing action and the thread tension discs, and the threads are pulled by the needle thread take-ups. During this action, the tension discs hold the individual threads under suitable tension to form neat seams. In this case, the tension devices each clamp a thread between two discs and push it by a spring to tense the thread. If the type of the thread is changed, however, the thickness and sliding resistance of the thread will change, so that the needle thread take-ups must be adjusted again. In the overlock sewing machine, for example, the needle thread and the upper or lower looper thread intersect on the upper or lower face of a cloth, and the upper and lower looper threads intersect at the side edge of the cut cloth to form loops at the cloth edge portion. Since, however, the seams (as shown in FIG. 9) are governed by the tensions of the individual threads, if the adjustment of the three threads is inferior, the intersections between the upper looper thread and the lower looper thread may appear on the upper side of the cloth, or one of the threads may be lashed so that neat seams cannot be formed.

The rotary type, on the other hand, is exemplified by a device (as disclosed in Japanese Patent Publication No. 4137/1961 or Japanese Utility Model Laid-Open No. 45754/1974), in which the threads are clamped by two thread tension discs which are rotated to feed the threads and the threads may be tensioned by forcing frictional members against the discs. In another rotary type device (as disclosed in Japanese Patent Laid-Open No. 101939/1979), the threads are wound on a rotor and frictional members are forced onto the rotor so that the rotor may be rotated to feed and tension the threads.

In the thread tensing device of the rotary type, however, the threads are fed in given lengths without regard for their type. Thus, the thread tensions do not vary even if the thread type is changed, so that the seams obtained have no irregularity. However, the means for winding the threads between the two thread tension discs, without any slippage, is complicated.

To eliminate these difficulties, there has been proposed a device (as disclosed in Japanese Patent Laid-Open No. 58592/1982), in which one of two rollers clamping a thread is controlled by an arithmetic control unit so that a predetermined amount of thread may be let off. Another sewing thread feeding device (as disclosed in Japanese Patent Laid-Open No. 45088/1990), is constructed as shown in FIG. 8, and includes: a let-off mechanism (i.e., a roller with an encoder) 101 for clamping and letting off a plurality of threads: electromagnetic thread grippers 102 disposed upstream of the let-off mechanism 101, each individually operating on one of the threads; and an electromagnetic common thread gripper 103 disposed downstream, so that the feeds of threads may be electrically controlled. With this latter thread feeding device, the threads are forcibly let off by the encoder roller 101, and the upstream thread grippers 102 are opened or closed, according to the feeds required of the individual threads, whereas the downstream thread gripper 103 is opened during the thread pulling actions of the thread take-ups and the upper and lower loopers, so that the threads may be individually fed in predetermined amounts.

Since the threads are forcibly fed by the rollers or the encoder rollers, by the above-described thread feeding devices, the threads can be accurately let off without any fear of tension fluctuation. However, because the thread grippers are electrically driven, there arises the problem that the device becomes complex and expensive. Especially in the case where the thread feeds are to be adjusted, the drive of the rollers or the opening/closing time periods of the thread grippers must be controlled by an arithmetic control unit, such as a computer, so that the cost of the device includes that of a microcomputer. Moreover, a plurality of threads are let off by a common let-off mechanism. Thus, in the case where different kinds of threads, e.g., a thick ribbon-shaped thread and an ordinary sewing thread, are combined to form a loop, a sufficient letting-off force may not be applied to the thinner thread although the thicker thread can be let off.

SUMMARY OF THE INVENTION

The present invention is intended to solve the above-specified problems of the prior art and has, as its objective, provision of a thread feeding device for a sewing machine, which device is able to adjust the feeds of a plurality of threads by a single adjusting operation, while having a remarkably simple construction, without any electric mechanism.

In order to achieve this object, according to one feature of the present invention, there is provided a thread feeding device for a sewing machine, which comprises: a shaft fixed on the machine body orthogonally of the direction of feed of a plurality of threads; a rotor mounted on the shaft for rotation in one direction only, intermittently for each seam; a plurality of thread holders mounted on the rotor for holding and letting off the plurality of threads individually; and drive means for driving the rotor in the one direction. In each thread holder the radius from the center of rotation of the rotor to the thread holding positions is set to a value corresponding to the individual feed required of the threads. In a specific embodiment, the thread holder is in the form of first and second disc members engaging each other and the rotor integrally connects the plurality of thread holders. Moreover, the thread feeding device further comprises: brake means for pushing the second disc members against the first disc members; and a regulating member for regulating the position of the second disc member relative to the second disc member, with the first and second disc members only partially abutting against each other. The drive means includes adjustment means for adjusting the degree of rotation of the rotor, and, in a preferred embodiment, includes: an eccentric cam fixed on the spindle of the sewing machine; a rocking link connected to the eccentric cam and reciprocally driven by the rotation of the spindle; and a one-way clutch for transmitting the motion of the rocking link to the rotor. The adjustment means includes: a rocking regulation member rotatably fixed to the rocking link; a guide member for rocking and guiding the rocking regulating member; and an adjustment member for adjusting the angle of the guide member with respect to the rocking link.

According to another feature of the present invention, there is provided a thread feeding device for a sewing machine, which comprises: a shaft fixed on the machine body orthogonally of the direction of feed of a plurality of threads; a rotor mounted on the shaft for rotation in one direction only, intermittently for each seam; first disc members fixed to opposing ends of the rotor; a plurality of pins projecting from each of the first disc members; second disc members, each formed with a of plurality holes for receiving the pins of the first disc members and for cooperating with the first disc members to hold the plurality of threads individually; brake means for pushing the second disc members against the first disc members; a regulating member for regulating the angular orientation of the second disc members such that the second disc members only partially abut against the first disc members at an inclination; and drive means for rotatably driving the rotor in one direction. The radii from the center of rotation of the rotor to the pins are set to values corresponding to the individual feeds required of the threads.

The rotor is rotated, intermittently for each seam, through a predetermined stroke by the drive means while holding the threads. Moreover, the radii from the center of rotation of the positions where the threads are held are set to values corresponding to the individual feeds of the threads so that the threads are fed out by the constant amounts, determined by such radii, as the common rotor makes one rotation. The drive means drives the rotor, as the rocking link connected to the eccentric cam is rocked by the rotation of the eccentric cam together with the spindle so that only one-way motion is transmitted to the rotor through the one-way clutch. Constant lengths of threads can be fed without fail by the drive of the rotor off of the spindle.

With the threads held between the first discs and the second discs, a braking force pushing the second discs against the first discs is applied by the brake means so that the threads are prevented from being further drawn off their bobbins by the inertia of the needle thread take-ups or the loopers, thus maintaining proper tensions on the threads at all times. Moreover, since the second discs have their angular positions regulated so as to abut against only portions of the first discs, the abutting portions can hold the threads without fail, and the remaining portions allow for clearances into which the threads can be introduced easily and reliably.

When the feeds of the threads are to be adjusted for changing the sewing width or the like, the motion of the rocking link of the drive means may be adjusted to change the degree of intermittent rotation of the rotor by adjusting the adjustment member of the adjustment means. In this case, the correlation between the feeds of the threads is held constant even if the rotation is changed, so that feeds of the plurality of threads can be adjusted all at once.

BRIEF DESCRIPTION OF THE DRAWINGS

FIG. 7 is a perspective view showing the entirety of a thread feeding device for a sewing machine according to another embodiment of the present invention;

FIG. 9 is a diagram showing a stitch made by a three-thread overlock sewing machine.

DESCRIPTION OF THE PREFERRED EMBODIMENT

Here will be described one embodiment of a thread feeding device for a sewing machine according to the present invention with reference to the accompanying drawings.

Figure 1:
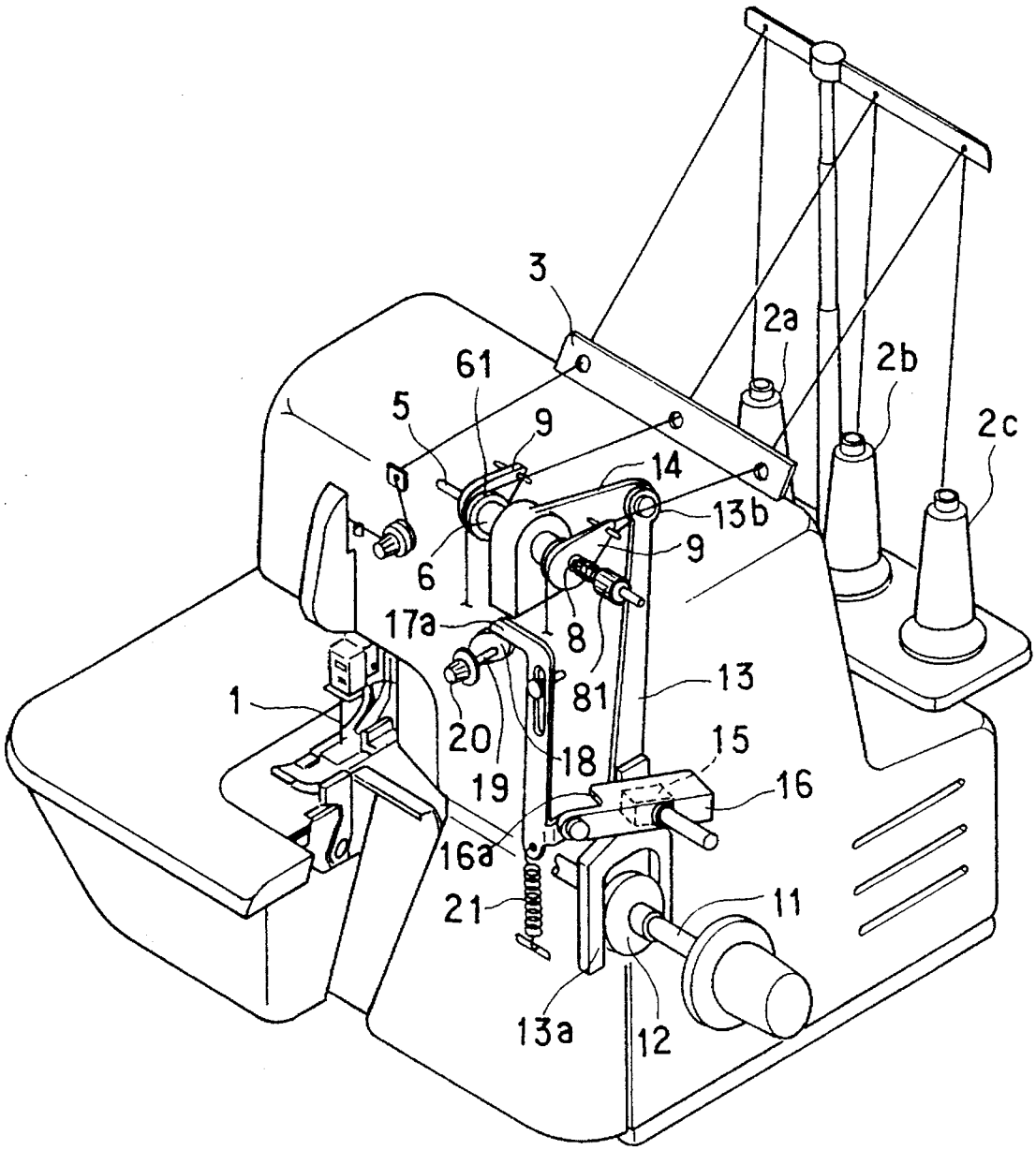
FIG. 1 is a perspective view showing the entire construction of one embodiment of an overlock sewing machine, equipped with a thread feeding device according to the present invention.

FIG. 1 is a perspective view showing the entirety of a three-thread overlock machine which is equipped with a thread feeding device in accordance with the present invention. This machine includes a needle 1 and upper and lower loopers, to which are fed threads from bobbins 2*a* to 2*c*, through individual thread guides 3. The thread feeding device according to the present invention is mounted in the thread feeding paths of the overlock machine.

Figure 2:
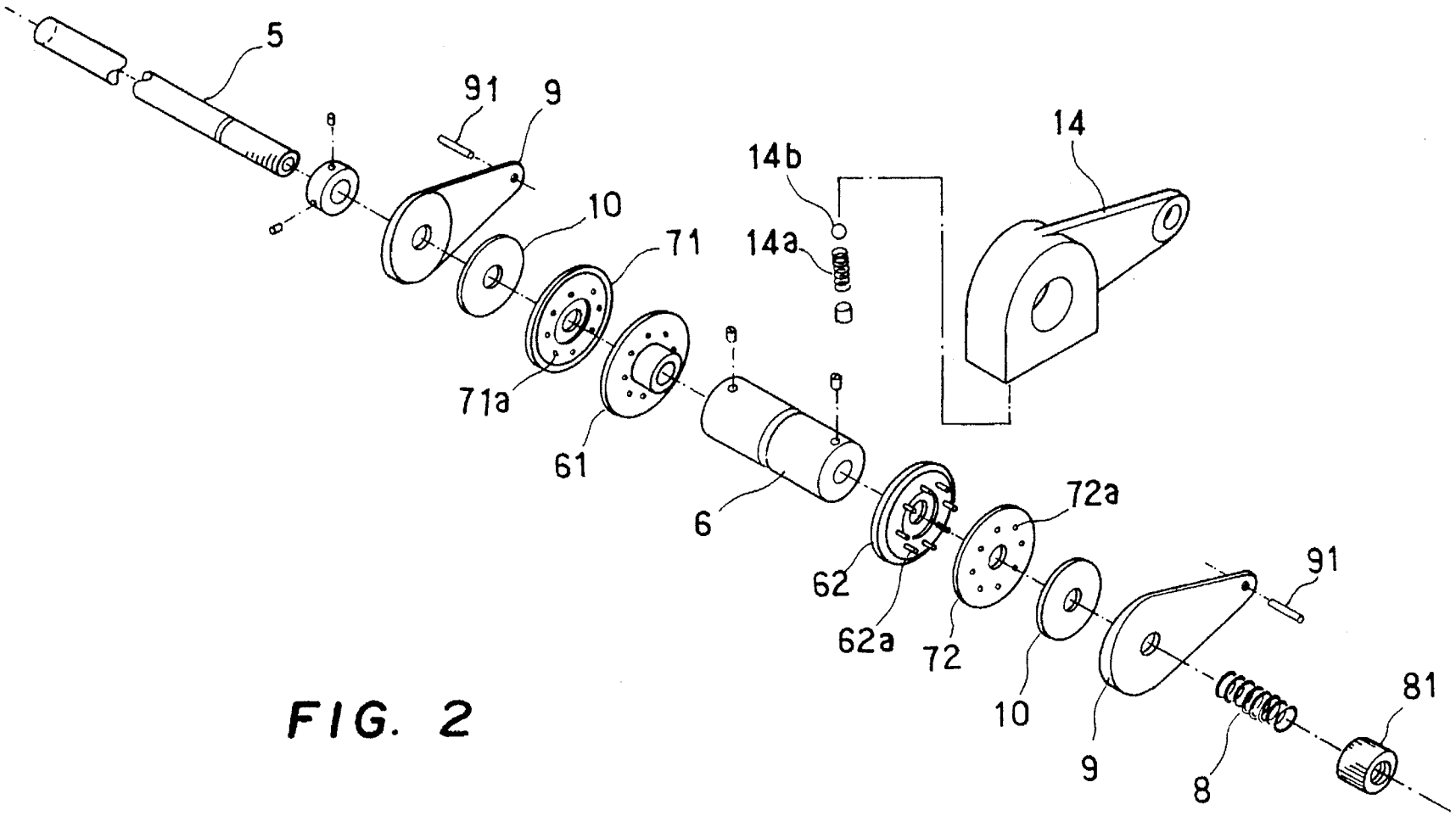
FIG. 2 is an exploded perspective view showing the thread feeding device of FIG. 1.
Figure 3:
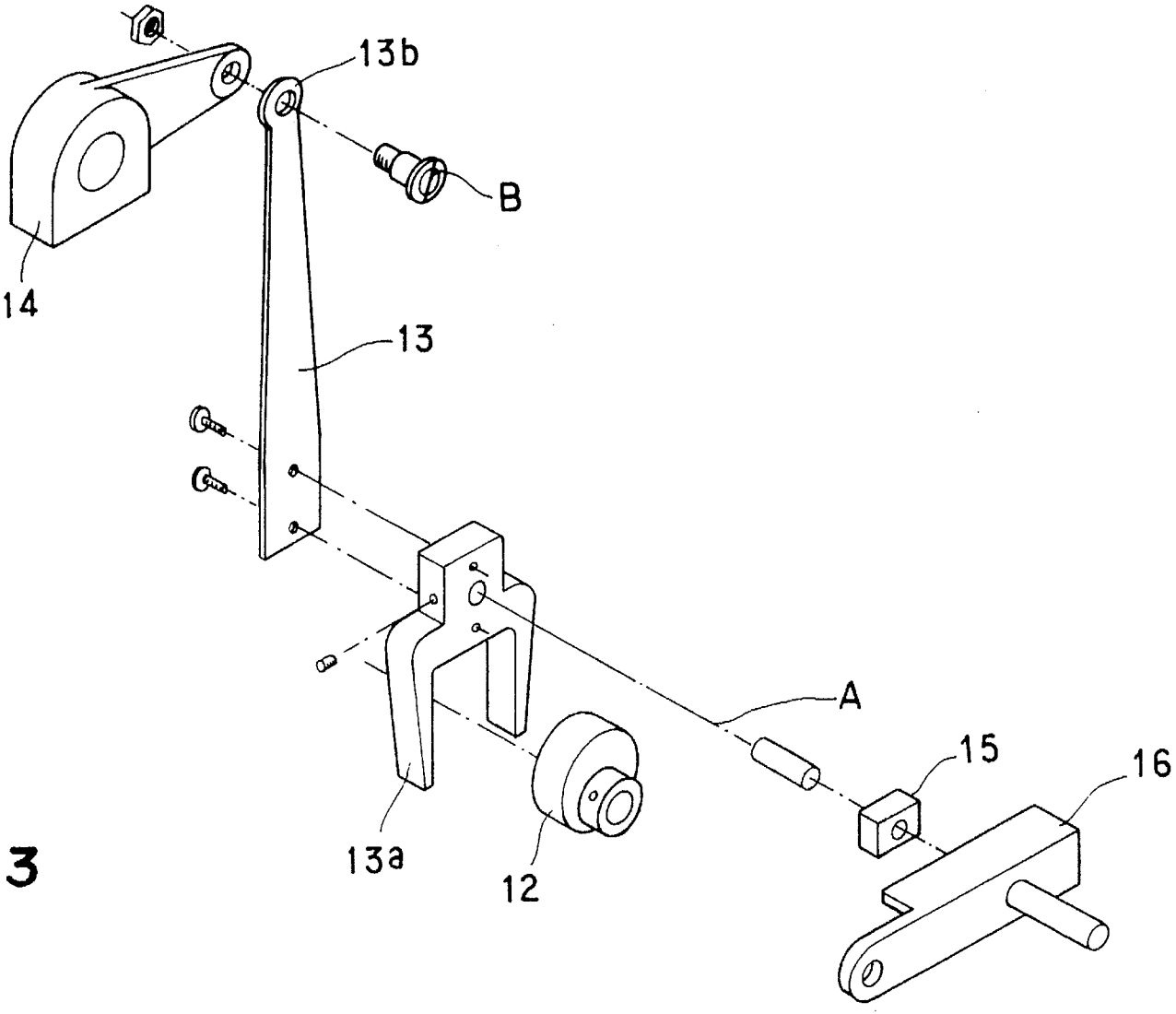
FIG. 3 is an exploded perspective view showing drive means for the thread feeding device of FIG. 1.
Figure 4:
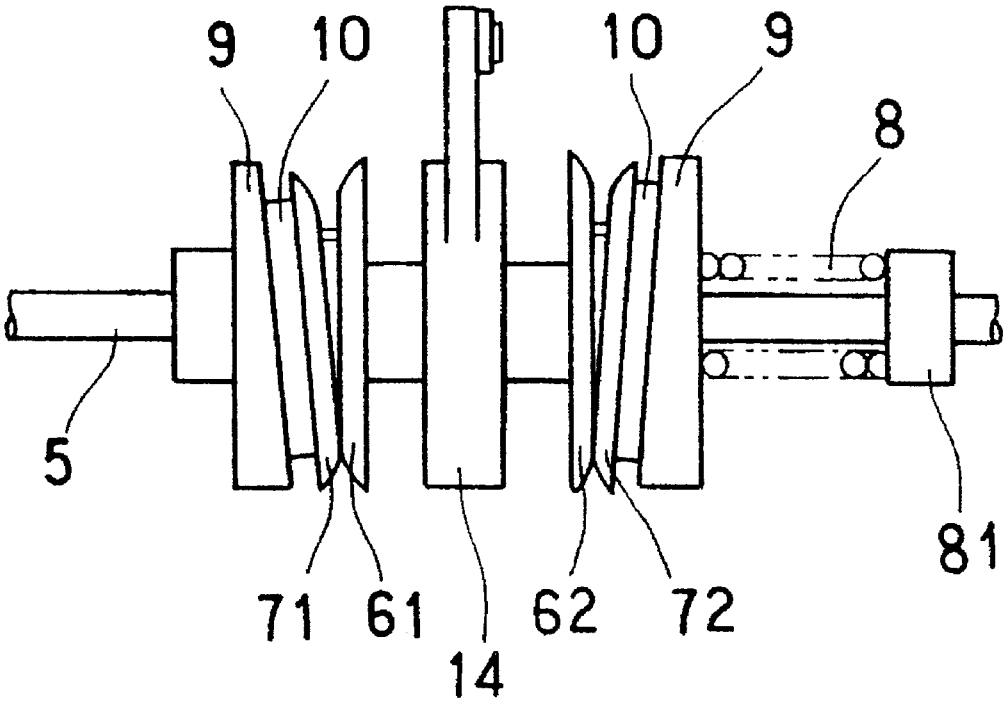
FIG. 4 is a side elevation showing an essential portion of the thread feeding device of FIG. 2.

The thread feeding device, as shown in FIGS. 2 to 4, includes, as its major components: a shaft 5 fixed in a machine body 4; a rotor 6 rotatably borne on the shaft 5 and having first discs 61 and 62 fixed at its two ends; second discs 71 and 72 which cooperate with discs 61 and 62, respectively; a spring 8 which is fitted on the shaft 5 and acts as brake means by urging the discs 71 and 72 against the discs 61 and 62, respectively; and regulating plates 9 which incline discs 71 and 72 with respect to the discs 61 and 62 as to contact only portions of the discs 61 and 62. Between the disc 71 (or 72) and the regulator plate 9 is sandwiched a slip stopper 10 made of felt, cork or skin for preventing inertial rotation of the discs. A slip stopper 10 is adhered to each of the discs 71 and 72 to rotate integrally therewith. This integral rotation ensures even wear of the slip stoppers 10. At one end of the shaft 5 is fastened an adjustment dial 81 for adjusting the braking force of the spring 8.

The rotor 6 is rotated, intermittently for each seam, on the shaft 5 by later-described drive means. The discs 61 and 62 fixed at the two ends of rotor 6 are each formed with a plurality of pins 61*a* and 62*a* extending from their faces and abutting against the discs 71 and 72. These pins 61*a* (or 62*a*) are arrayed on a circle of a predetermined radius. On the other hand, the discs 71 and 72 are formed with holes which receive those pins 61*a* and 62*a*. The engagement between those pins and holes determines the position in which the threads are held by the discs 61 and 71 (and 62 and 72). Specifically, as the rotor 6 rotates while the threads are being held by the individual discs, the threads are let off and fed from the feed side. The amount of thread feed is determined by the rotation of the rotor 6 and the radial position (or radius) at which the threads are held. In the overlock machine, as shown, the feed of thread necessary for one seam is the same for the upper and lower loopers so that the radial positions at which the threads are held, namely, the positions of the pins and the holes, are the same for the two discs 61 and 62 (or 71 and 72). The adjustment of rotation of the rotor 6 will be described hereinafter.

With inclination of their abutting faces, when the discs 71 and 72 are urged against the discs 61 and 62 by the regulator plates 9, these discs come into contact with each other to hold the thread while leaving a relatively large gap at the opposite side for facilitating thread insertion.

The regulator plate 9 is fixed on the machine body by a pin 91 that it may not rotate with the shaft 5. The regulator plate 9 regulates the inclination of the discs 71 or 72 with respect to the shaft 5. The spring 8 imparts the thread holding force to the discs and prevents the discs 71 and 72 from being rotated by inertial force. The braking force of the spring 8 is adjusted by turning the adjustment dial 81.

Thus, the discs 61 and 71 (or 62 and 72) hold the thread by the holding force given by the spring 8, so that they can feed the thread, as the rotor 6 rotates, by an amount determined by the amount of rotation.

The rotor 6 may be driven by the pulling action of the thread by the takeup and the upper and lower loopers. In this case, however, the thread let-off has to be adjusted by adjusting the braking force of the spring 8. Hence, it is preferable to provide drive means for positively rotating the rotor 6, while the braking force of the spring is kept constant, and to make the rotation of the drive means adjustable.

Figure 5B:
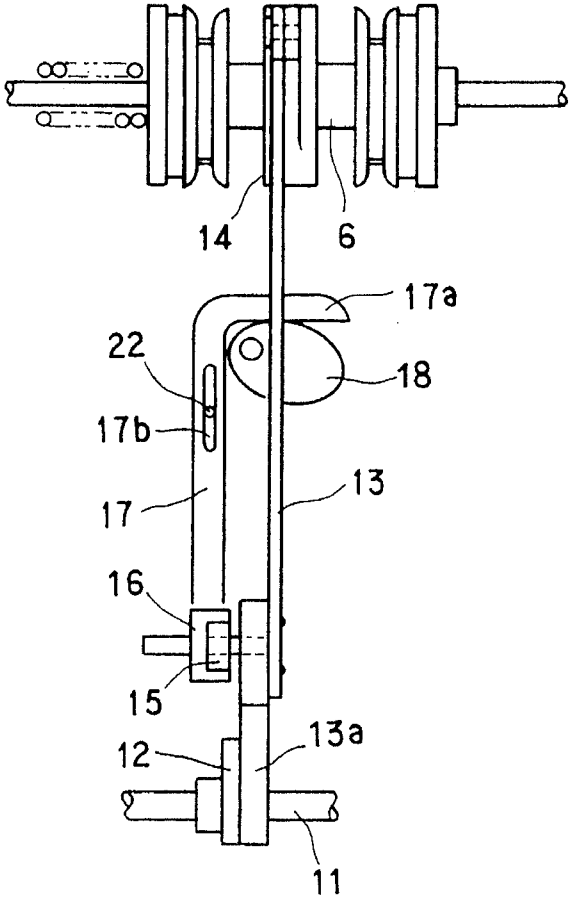
FIGS. 5(*a*) and 5(*b*) are side elevation and a top plan view, respectively, showing the drive means of the thread feeding mechanism of the present invention.
Figure 5A:
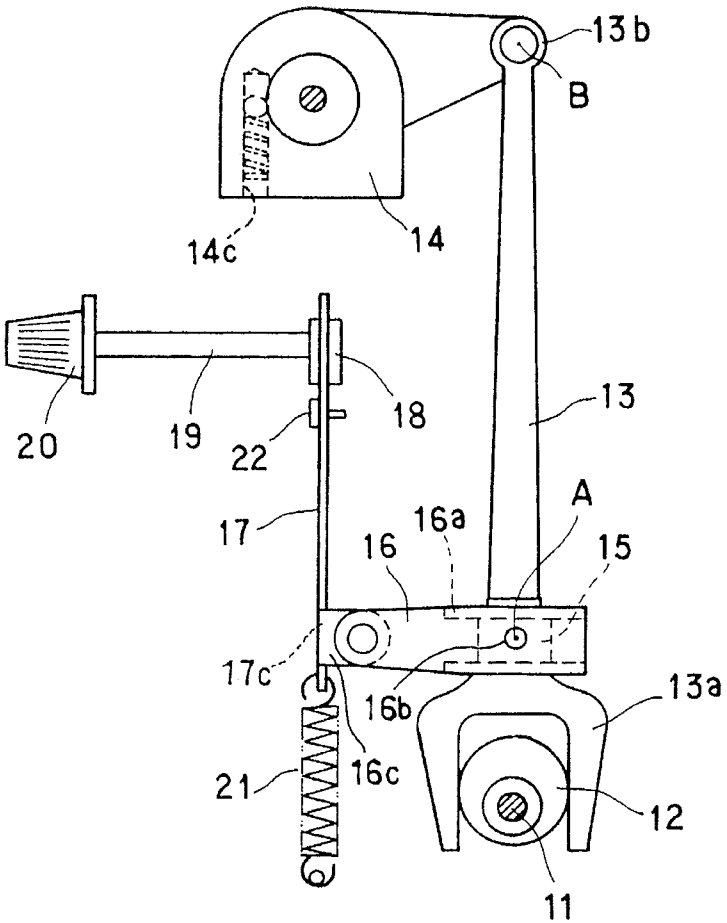

In the thread feeding device of the present embodiment, the drive means for rotating the rotor 6 is composed, as shown at in FIGS. 5(*a*) and 5(*b*) of: an eccentric cam 12 fixed on a spindle 11; a rocking link 13 having a follower portion 13*a* engaging the eccentric cam 12; and a one-way clutch 14 connected to the other end 13*b* of the rocking link 13 and fixed on the rotor 6. As the eccentric cam 12 rotates together with the spindle 11, its rotation is converted into the rocking motions of the rocking link 13. These rocking motions of the end portion 13*b* of the rocking link 13 rotate the rotor 6 through the one-way clutch 14.

The rocking link 13 is equipped with adjustment means for adjusting the rocking motion of its end 13*b*, i.e., the rotation of the rotor 6. This adjustment means includes a rocking regulating member 15 rotatably mounted on rocking link 13 in the vicinity of the follower portion 13*a*; a guide member 16 supporting the rocking regulating member 15 slidably along its guide groove 16*a*; an adjustment arm 17 connected to one end of the guide member 16 and acting to adjust the angle of the guide member 16 with respect to the rocking link 13 by moving its end 16*c*; a cam 18 on which rides a bent portion 17*a* formed at the end of the adjustment arm 17; and an adjustment knob 20 which is mounted for rotation together with the cam 18 on shaft 19.

The guide member 16 is so fixed on the body frame 4 by a pin 16*b* which projects from its face opposite the guide groove 16*a*, so that it can turn on the pin axis A. At the other end 16*c* of the guide member 16, on the other hand, there is fixed a portion 17*c* of the adjust arm 17 so that the angle of the guide groove 16*a* with respect to the rocking link 13 can be adjusted by the adjustment arm 17.

Figure 6:
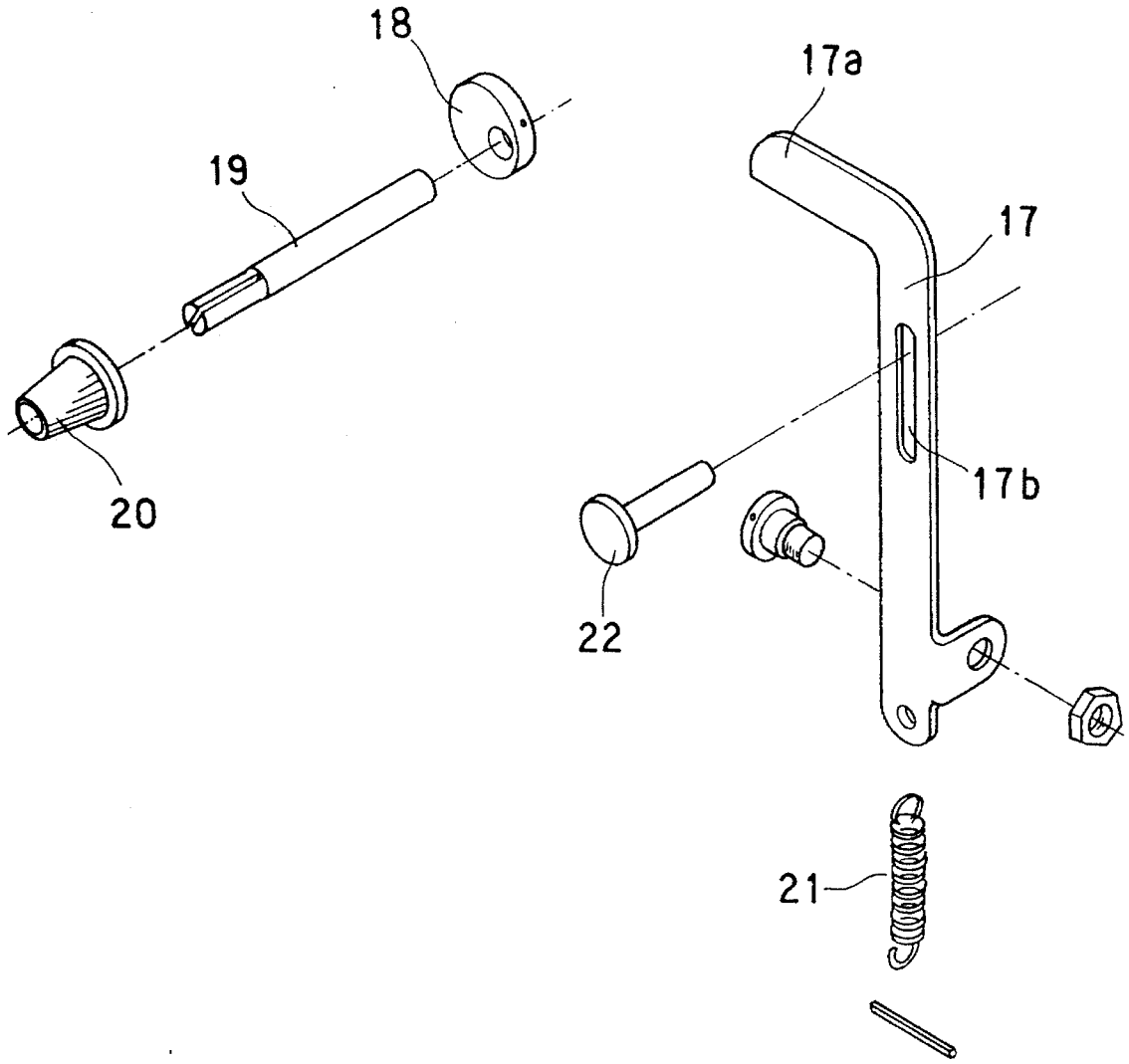
FIG. 6 is an exploded perspective view showing adjustment means for the thread feeding device according to the present invention.
Figure 8:
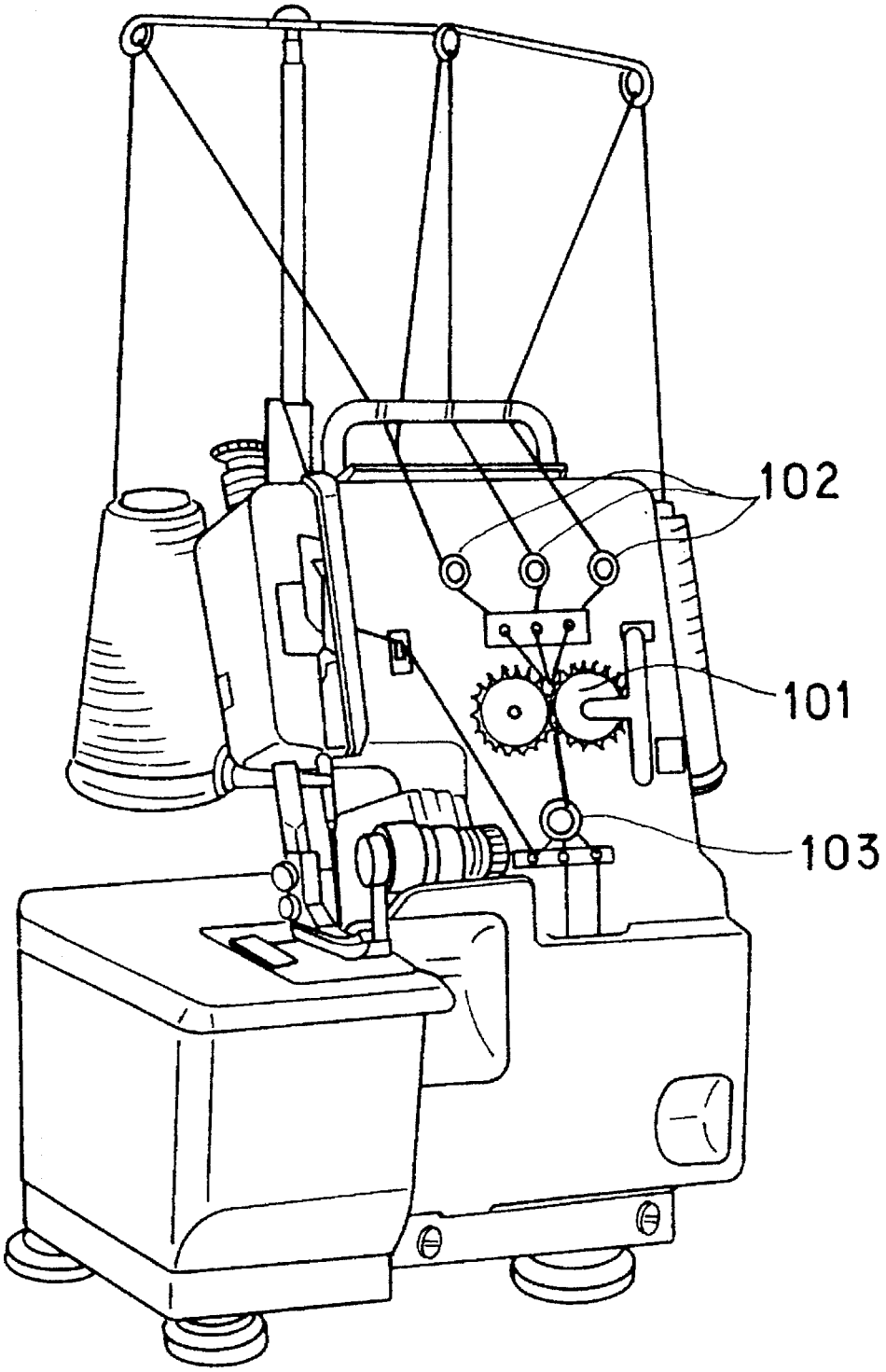
FIG. 8 is a perspective view of the thread feeding device for a sewing machine of the prior art.

As shown in FIG. 6, this adjustment arm 17 has one end with a bent portion 17*a* engaging the cam face of the cam 18 and an opposite end attached to a spring 21 so that it is urged downward in the drawing by the spring 21. As a result, the adjustment arm 17 has its position determined depending upon the position of the cam face of the cam 18 engaging its bent portion 17*a*. In other words, this cam 18 is an eccentric cam which can be rotated by the adjustment knob 20 to adjust the position of the adjustment arm 17. The adjustment arm 17 has a longitudinal center slot 17*b*, through which extends a pin 22 fixed on the machine body to guide the vertical motions of the adjustment arm 17, as taken in the drawing.

As the position of the cam face engaging the adjustment arm 17 is changed by the adjustment knob 20 so that the adjustment arm 17 is moved to a predetermined position, the guide member 16 becomes inclined as it pivots about the pin A. When the guide member 16 is positioned so that it orthogonally intersects the straight line joining the center of the spindle 11 and the joint portion B of the rocking link 13, the eccentricity of the eccentric cam 12 is relieved so that it will not lift the end portion 13*b* of the rocking link 13. When, on the other hand, the guide member 16 is inclined (at an angle of inclination other than 90 degrees) with respect to the straight line joining the spindle center and the joint portion of the rocking link 13, its guide groove 16*a* is correspondingly inclined by the eccentricity of the eccentric cam 12 so that the rocking link 13 has its end portion 13*b* moved a predetermined distance to adjust the rocking stroke. The rocking motions of the joint portion B are transmitted to the rotor 6 through the one-way clutch 14 so that the rotor 6 intermittently rotates in one direction on the shaft 5.

Here, the one-way clutch 14 has its ball 14*b* urged, in its feeding motion, by a spring 14*a* into biting engagement with the rotor 6 so that it transmits rotational motion to the rotor 6. When the one-way clutch 14 is rotated in the opposite direction, on the other hand, the ball 14*b* is pushed back against the urging of the spring 14*a* so that the one-way clutch 14 slips on the rotor 6 and transmits no motion.

The degree of rotation (i.e., stepwise advance) of the rotor 6 in one motion depends upon the extent of the rocking motion of the joint portion B of the rocking link 13 transmitted to the one-way clutch 14, and the extent of this rocking motion of the joint portion B, in turn, depends upon the angle of the guide member 16, i.e., the position of the adjust arm 17, which is adjusted by the adjustment knob 20.

The operation of the thread feeding device having the above construction will now be described. First of all, the upper and lower looper threads are extracted from their individual bobbins 2*a*, 2*b* and 2*c* and inserted via the thread guide 3 into the clearances between the discs 61 and 71 and between the discs 62 and 72. The threads are then threaded via the thread guides at the downstream side into the feeders of the individual loopers. The threads can be easily inserted into the discs because of the wider clearances between the discs at the upstream side of the thread feed. The threads thus inserted come into abutment against the pins of the discs so that they will not enter the discs any further but will be held between the discs.

After these threading operations, the sewing operations are started. Then, the spindle 11 rotates so that the rocking link 13 completes one up and down reciprocation during one rotation of the spindle 11. The upward motion of the rocking link 13 is transmitted through the one-way clutch 14 to the rotor 6 so that the rotor 6 rotates a predetermined degree while holding the threads between the discs 61 and 71 and between the discs 62 and 72. As the rotor 6 rotates, the threads are fed out to such extents as are determined by the degree of rotation of the rotor 6 and the effective radii of the holding portions of the discs. The threads thus fed out to the downstream of the rotor 6 are extracted during the latter half of the rotation of the spindle 11 by the extracting actions of the loopers. Since the threads are fed out by the predetermined amount, they are tensioned by tension discs, unlike the prior art, so that they can form soft seams. At the time of the thread extracting actions of the loopers, on the other hand, the inertial force of the rotor 6 tends to pull the threads excessively. However, the rotor 6 does not rotate responsive to that inertial force, but holds the threads, because it is braked by the spring 8 and the slip stopper 10.

Thus, the feed of all the threads is determined by the rotation of the rotor 6, and the individual threads are held by their respective discs. As a result, the threads can always be fed in equal lengths to the loopers, even if the upper looper thread and the lower looper thread are different in thickness and kind.

To adjust the feed of the threads to accommodate a change in the looping width, the adjustment knob 20 is turned to adjust the position of engagement between the cam 18 and the adjustment arm 17. As a result, the adjustment arm 17 is moved vertically thereby changing the angle between the guide member 16 and the locking link 13.

Although the foregoing embodiment has been described only in the context of feed of the looper threads, of course, feed of needle threads can be similarly accomplished. In a two-thread overlock sewing machine for looping operations with one needle thread and one looper thread, for example, the needle thread may be held and fed by one pair of discs 61 and 71, and the looper thread may be held and fed by the other pair of discs 62 and 72. In a four-thread overlock sewing machine for looping operations with two needle threads and two looper threads, on the other hand, a thread feeding device for the needle threads and a thread feeding device for the looper threads may be utilized. In the latter case, too, only one adjustment is needed for the two needle threads and one for the two looper threads so that the adjusting operation can be remarkably simplified.

If, as in the former case, the thread feeds required for a particular seam are different, it is sufficient to use discs having different pin and hole positions. Specifically, if one looper thread requires a longer feed than the other looper thread, one pair of discs 61 and 71 may have their pins (or holes) positioned on a larger diameter circle than those of the other pair of discs 62 and 72.

The foregoing embodiment is constructed such that the threads are held in positions determined by the engagement between the pins and holes of the discs. However, the discs which abut against each other may, alternatively, be formed with mating raised portions and recessed portions for supporting the threads between the discs. However, such a structure must prevent the threads from stealing into the clearances between the raised and recessed portions. Although the foregoing embodiment adopts discs as the thread holders, the rotors for holding the threads should not be limited to the discs but may instead be paired rollers 60 and 60' as shown in FIG. 7. In this modification, moreover, the diameters of the thread holding rollers may differ in accordance with the required feeds of the threads, as shown in FIG. 7.

Furthermore, the thread feeding device of the present invention can be applied, not only to an overlock sewing machine, but also a sewing machine equipped with a looper such as a double loop sewing machine.

As is now apparent from the foregoing description, according to the thread feeding device for a sewing machine of the present invention, the threads are held by the rotor having its rotation controlled and are fed by rotating the rotor to a predetermined extent, and the radii of the thread holding portions from the center of the rotor are set to the values corresponding to the feeds of the threads necessary for seams so that the individual threads can form harmonized soft seams. Moreover, the rotor is constructed to hold the plurality of threads so that these threads can be adjusted all at once merely by one adjustment of the rotation of the rotor. Moreover, the thread feeding device of the present invention effects all of the holding of the threads with the rotor, the rotation of the rotor and so on exclusively mechanically so that the sewing machine can be simplified, easily assembled and provided at a low cost without requiring any electrical control.

What is claimed is:

1. A thread feeding device for mounting on a sewing machine to withdraw threads from wound packages for feeding to a stitching mechanism on the sewing machine, said thread feeding device comprising:

a rotor mounted on the sewing machine for rotation about a longitudinal axis perpendicular to the direction of feed of the threads;

drive means for rotatably and intermittently driving said rotor in increments of rotation;

plural thread holders mounted on said rotor for rotation therewith, each of said thread holders supporting at least one of the threads at a support point radially distanced from said longitudinal axis, each of said thread holders drawing off a predetermined length of the threads responsive to each increment of rotation of said rotor, whereby said predetermined length is determined for each thread holder by the degree of rotation in one of said increments of rotation.

2. The thread feeding device of claim 1 wherein each of said thread holders comprises first and second discs mounted on said rotor for rotation therewith, said first disc being inclined relative to said second disc, whereby said first and second discs abut at said support point.

3. The thread feeding device of claim 1 further comprising rotation adjustment means for adjusting the increment of rotation of said rotor, thereby determining the predetermined length of each thread drawn off of its supply package in each increment of rotation.

4. A thread feeding device in accordance with claim 1 wherein said sewing machine includes a rotatable spindle and wherein said drive means comprises:

an eccentric cam fixed on said spindle for rotation therewith;

a linkage arm having a cam follower at one end engaging said eccentric cam whereby reciprocating motion is imparted to said linkage arm responsive to rotation of said spindle, said linkage arm being connected to said rotor through a one way clutch whereby said rotor is rotated by said linkage arm when said linkage arm is driven by said cam in a first direction and no rotation is imparted to said rotor by said linkage arm as said linkage arm retreats in the opposite direction.

5. The thread feeding device of claim 4 further comprising rotation adjustment means for changing the length of said stroke of said linkage arm, thereby changing the increment of rotation of said rotor, whereby said rotation adjustment means sets said predetermined length of thread drawn off of the supply package in each increment of rotation.

* * * * *